United States Patent [19]

Wirtgen

[11] Patent Number: 4,966,418

[45] Date of Patent: Oct. 30, 1990

[54] FRONT-LOADING CUTTING DEVICE FOR CUTTING UP DAMAGED ROAD SURFACES

[76] Inventor: Reinhard Wirtgen, Hohner Strasse 2, D-5469 Windhagen, Fed. Rep. of Germany

[21] Appl. No.: 470,879

[22] Filed: Jan. 26, 1990

[30] Foreign Application Priority Data

Feb. 6, 1989 [DE] Fed. Rep. of Germany ..... 3903482

[51] Int. Cl.[5] ..... E01C 23/12

[52] U.S. Cl. ..... 299/39; 37/190; 404/90

[58] Field of Search ..... 299/36, 39, 64; 404/90, 404/91; 51/176; 37/108 R, 190

[56] References Cited

U.S. PATENT DOCUMENTS 4,193,636 3/1980 Jakob ..... 299/39

4,723,867 2/1988 Wirtgen ..... 404/90

*Primary Examiner*—Ramon S. Britts

*Assistant Examiner*—David J. Bagnell

*Attorney, Agent, or Firm*—W. Thad Adams, III

[57] ABSTRACT

This invention relates to a front-loading cutting device for cutting up damaged road surfaces, having a self-driving chassis, a pair of front wheels and a pair of rear wheels, a cutting cylinder which is height-adjustable in relation to the chassis and a loading belt arranged at the front end, in which the cutting cylinder is arranged at the rear of the chassis and a transport belt is provided for the cut-up material below the chassis between the cutting cylinder and the loading belt.

5 Claims, 3 Drawing Sheets

FRONT-LOADING CUTTING DEVICE FOR CUTTING UP DAMAGED ROAD SURFACES

Figure 1:
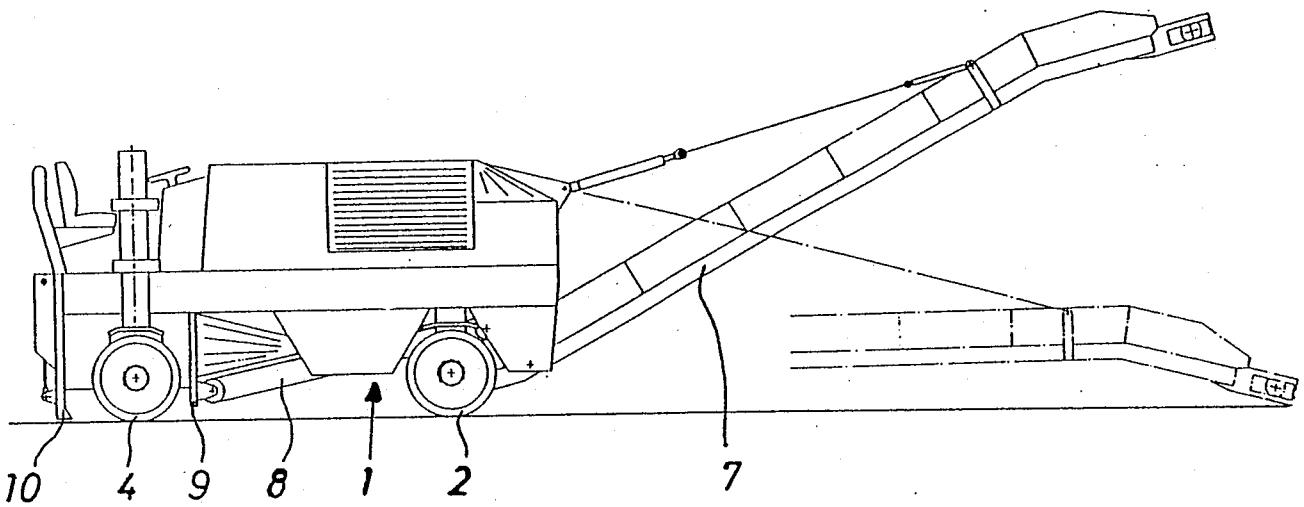

The invention relates to a front-loading cutting device for cutting up damaged road surfaces, consisting of a self-driving chassis with a pair of steerable front wheels and a pair of rear wheels, and a cutting cylinder which is height-adjustable in relation to the chassis, and a loading belt arranged at the front end.

Front-loading cutting machines of this kind are already known and used. The disadvantage of these known machines consists in that the cutting cylinder is arranged in the vicinity of the loading belt. This results in the front wheels of the chassis rolling on the road surface which has not been cut up while the rear wheels roll on the region of the road surface which has been cut up.

As a consequence, with the exceptionally heavy weight of cutting machines of this kind, in particular when cutting is relatively deep, the rear wheels are no longer sufficiently supported by the remaining road surface and sink in.

This causes the position of the chassis to change and thus the reference point for the cutting depth set. This results finally in uneven cutting work being completed.

A further disadvantage of these known front-loading cutting devices consists in the fact that the cutting cylinder, arranged near to the loading belt, can generally not be arranged flush with one side of the chassis, such that cutting work going up to the edge of the road can only be carried out with difficulty.

Setting out from this previously known state of the art, it is now the object of the present invention to eliminate these disadvantages described above and to provide a front-loading cutting device, with which firstly all the chassis wheels run on the road surface which has not been cut up and also, if appropriate, cutting work can be carried out up to the edge of the road.

According to the invention this object is achieved by a front-loading cutting device of the type described at the beginning which is characterized in that the cutting cylinder is arranged at the rear of the chassis and a transport belt is provided for the cut-up material below the chassis between the cutting cylinder and the loading belt.

The cutting cylinder, arranged height-adjustably on the chassis, normally rotates in opposite direction, i.e. opposite to the direction of rotation of the chassis wheels. The cut-up material consequently gathers in front of the cutting cylinder and is picked up there by the transport belt and transported below the chassis through to the front where it falls on to the loading belt. The loading belt itself picks this material up and transports it on to the transport vehicle travelling in front of the cutting machine. In this case it is expedient for the loading belt to be swivelable laterally to a certain extent, for example by 30° to each side.

It is guaranteed by this swivelability that the cut-up material can be distributed evenly over the loading surface of the transport vehicle.

It is expedient to provide the cutting cylinder with a collector shield, arranged in front of it, with a passage opening for the cut-up material. A collector shield of this kind and the passage opening provided in it guarantee that the cut-up material falls directly on to the transport belt and is thus transported away completely via the loading belt. If appropriate, a further corresponding collector shield can also be provided behind the cutting cylinder, which shield collects the material which may have been transported to the rear by the cutting cylinder, such that a surface is obtained which is completely free from cut-up material.

According to an advantageous embodiment of the front-loading cutting device according to the invention, the cutting cylinder is expediently arranged between the rear wheels of the chassis and its axis lies expediently in the vertical plane in which the axles of the rear wheels also lie.

According to a particularly advantageous embodiment of the present invention, the cutting cylinder ends flush with one side of the chassis, the rear wheel on this side of the chassis running in the normal position laterally beside the chassis.

With this embodiment, a swivelling mechanism is provided additionally by means of which the rear wheel running laterally beside the chassis can be swivelled to the front about a vertical axis, such that it runs in front of the cutting cylinder inside the border of the chassis.

By means of an embodiment of this kind it is possible to cut up the road surface up to the edge of the road, the rear wheel running in front of the cutting cylinder ensuring that the cutting depth once set is maintained.

Figure 2:
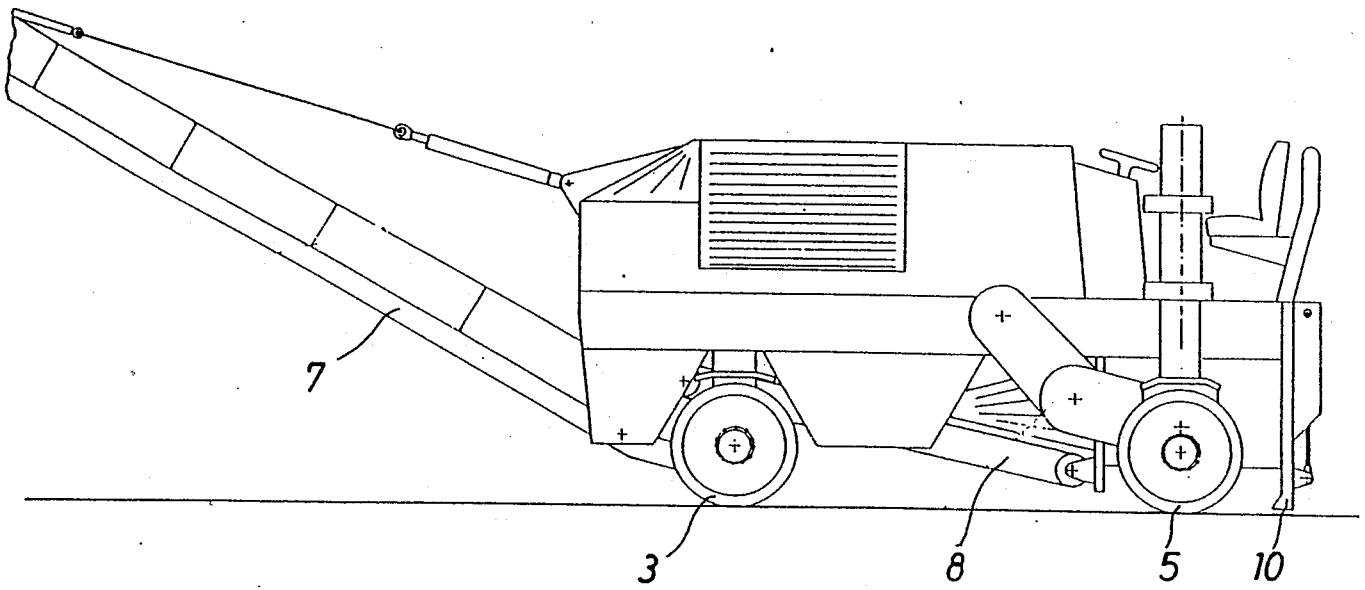
Figure 3:
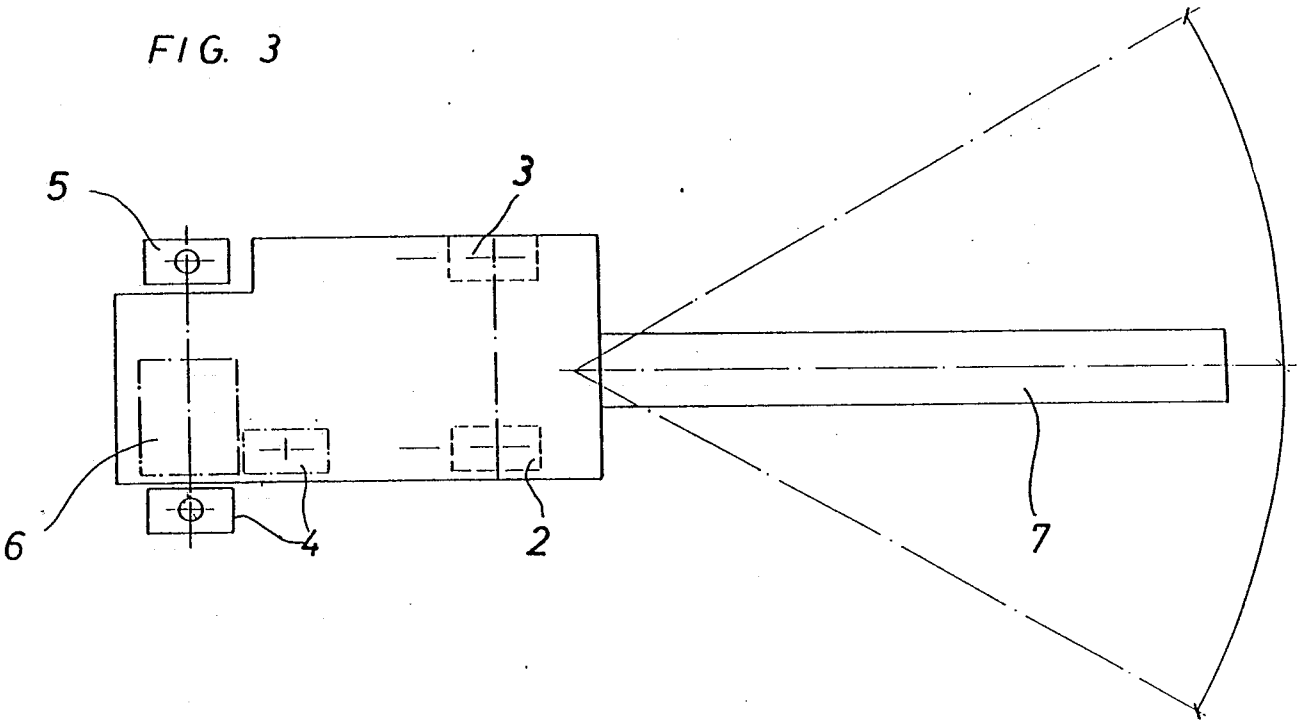

The front-loading cutting device according to the invention is described in greater detail below with reference to the exemplary embodiments illustrated in the attached drawings, in which:

FIG. 1 shows a lateral view of the front-loading cutting device according to the invention, FIG. 2 shows another lateral view of the device according to the invention, FIG. 3 shows a schematic plan view of the device according to the invention.

The front-loading cutting device illustrated in FIG. 1 consists of a self-driving chassis 1 having a pair of front wheels 2, 3 and a pair of rear wheels 4, 5, the cutting cylinder 6, as can be seen from FIG. 3, being mounted between the rear wheels 4 and 5. Situated below the chassis 1, between the cutting cylinder 6 and the loading belt 7, is the transport belt 8 which picks up the cut-up material at the passage opening of the collector shield 9 and transports it to the loading belt 7, from where the said material is loaded on to the transport vehicle travelling in front of the cutting machine.

Another additional collector shield 10 is provided behind the cutting cylinder 6, by means of which it is guaranteed that the cut-up surface remains free from cut-up material.

As can be seen in detail in particular from FIG. 3, the rear wheel 4 is arranged laterally beside the chassis and can, if required, be swivelled in front of the cutting cylinder 6 such that the rear wheel 4 runs inside the border line of the chassis and the cutting cylinder 6 ending approximately flush with the chassis can cut up the road surface up to the edge of the road.

In this case it is ensured that, during the cutting process, all the chassis wheels run on the road surface which has not been cut up.

I claim:

1. Front-loading cutting device for cutting up damaged road surfaces, having a self-driving chassis with a pair of front wheels and a pair of rear wheels, and having a cutting cylinder which is height-adjustable in relation to the chassis, and having a loading belt arranged at the front end, characterized in that the cutting cylinder (6) is arranged at the rear of the chassis (1) and a transport belt (8) is provided for the cut-up material below the chassis (1) between the cutting cylinder (6) and the loading belt (7).

2. Front-loading cutting device according to claim 1, characterized in that the cutting cylinder (6) is arranged between the rear wheels (4, 5) of the chassis (1).

3. Front-loading cutting device according to claim 1, characterized in that the cutting cylinder (6) ends flush with one side of the chassis and the rear wheel (4) provided on this side of the chassis can be swivelled about a vertical axis in front of the cutting cylinder (6).

4. Front-loading cutting device according to one of claims 1 to 3, characterized in that the cutting cylinder (6) is provided with a collector shield with a passage opening for the cut-up material in front of the cutting cylinder.

5. Front loading cutting device according to claim 4, characterized in that an additional collector shield (10) is provided behind the cutting cylinder.

* * * * *